US010267082B2

(12) United States Patent
Knapp

(10) Patent No.: US 10,267,082 B2
(45) Date of Patent: Apr. 23, 2019

(54) PROFILE FOR FASTENING PANES

(71) Applicant: KNAPP GMBH, Euratsfeld (AT)

(72) Inventor: Friedrich Knapp, Bad Kreuzen (AT)

(73) Assignee: Knapp GmbH, Euratsfeld (AT)

( * ) Notice: Subject to any disclaimer, the term of this patent is extended or adjusted under 35 U.S.C. 154(b) by 0 days.

(21) Appl. No.: 15/776,638

(22) PCT Filed: Nov. 9, 2016

(86) PCT No.: PCT/EP2016/077073

§ 371 (c)(1),
(2) Date: May 16, 2018

(87) PCT Pub. No.: WO2017/084919

PCT Pub. Date: May 26, 2017

(65) Prior Publication Data

US 2018/0355656 A1 Dec. 13, 2018

(30) Foreign Application Priority Data

Nov. 18, 2015 (EP) ..... 15195100

(51) Int. Cl.
*E06B 3/30* (2006.01)
*E06B 3/58* (2006.01)

(52) U.S. Cl.
CPC ..... *E06B 3/5828* (2013.01); *E06B 3/302* (2013.01); *E06B 3/5807* (2013.01)

(58) Field of Classification Search
CPC ..... E06B 3/5828; E06B 3/302; E06B 3/5807
See application file for complete search history.

(56) References Cited

U.S. PATENT DOCUMENTS 8,495,841 B2 * 7/2013 DeGroff ..... E05D 15/165 296/146.15
8,505,262 B2 * 8/2013 Senge ..... B60J 10/265 296/1.08
8,584,426 B2 * 11/2013 Valler ..... E06B 3/549 52/656.5

(Continued)

FOREIGN PATENT DOCUMENTS

EP 3170961 B1 * 7/2018 ..... E06B 3/302
NL 1034396 C2 3/2009
WO 2004103754 A1 12/2004

OTHER PUBLICATIONS

English Translation of International Preliminary Report on Patentability in corresponding International Application No. PCT/EP2016/077073.

(Continued)

*Primary Examiner* — Rodney Mintz
(74) *Attorney, Agent, or Firm* — Hoffmann and Baron, LLP

(57) ABSTRACT

A profile made of plastic material to fasten a pane to a frame, comprising a first fastening section that can be placed against the pane and a second fastening section that can be anchored to the frame and at least one clamping section projecting away from the fastening sections, the clamping section having a catch to clamp a covering strip, wherein the catch sticks out on one or both sides of the clamping section and wherein one part of the catch is made of a more elastic plastic material than the clamping section with the remaining part of the catch.

11 Claims, 4 Drawing Sheets

(56) References Cited

U.S. PATENT DOCUMENTS

| | | | | |
|---|---|---|---|---|
| 8,904,719 | B2 * | 12/2014 | Knapp | E06B 3/5828 52/204.53 |
| 9,683,403 | B2 * | 6/2017 | Wang | E06B 3/5892 |
| 2005/0115193 | A1 * | 6/2005 | Brunnhofer | E06B 3/2632 52/717.02 |
| 2005/0183351 | A1 * | 8/2005 | Brunnhofer | E06B 3/26305 52/204.5 |
| 2006/0266460 | A1 | 11/2006 | Kreye | |
| 2008/0196342 | A1 * | 8/2008 | Franklin | E06B 3/26341 52/309.1 |
| 2012/0204504 | A1 * | 8/2012 | Knapp | E06B 3/5828 52/204.63 |
| 2014/0053479 | A1 * | 2/2014 | Valler | E06B 3/964 52/204.5 |

OTHER PUBLICATIONS

EP Office Action dated Jun. 10, 2017 in corresponding European Patent Application No. 15 195 100.1, pp. 1-5.
International Preliminary Report on Patentability in corresponding International Application No. PCT/EP2016/077073.

* cited by examiner

PROFILE FOR FASTENING PANES

CROSS-REFERENCE TO RELATED APPLICATIONS

This application is a National Phase application of International Application No. PCT/EP2016/077073 filed Nov. 9, 2016 which claims priority to the European Patent Application No. 15 195 100.1 filed Nov. 18, 2015, the disclosures of which are incorporated herein by reference.

TECHNICAL FIELD

This invention relates to a profile made of plastic material to fasten a pane to a frame, comprising a first fastening section that can be placed against the pane and a second fastening section that can be anchored to the frame and at least one clamping section projecting away from the fastening sections, the clamping section having a catch to clamp a covering strip.

BACKGROUND

Such a profile is disclosed in WO 2009/122305 A2 and is used to mount panes such as laminated glass panes, interior wall paneling, door panels, etc., in the frames of windows, doors, display cases, etc. After the pane has been mounted in the frame with the help of the profile, the covering strip is put onto the profile to cover the joint between the pane and the frame and, as a rule, also equally to cover the entire profile for the purpose of esthetics, insulation, and protection.

Known profiles use two clamping strips with facing hook-shaped catches, between which the covering strip is clipped in with a projection. This does securely latch the covering strip, but no longer allows the latter to be removed, for example if the pane has to be replaced, without destroying the covering strip, especially if it is made of wood.

A profile according to the preamble of claim 1 is disclosed in NL 1 034 396 C2. The catch of this known profile is made entirely of a flexible material.

SUMMARY

The invention has the goal of creating a fastening profile for panes, this fastening profile allowing nondestructive removal of the covering strip, and thus removal and replacement of the pane.

This is accomplished with a profile of the type mentioned at the beginning, this profile being characterized according to the invention in that the catch sticks out on one or both sides of the clamping section and in that one part of the catch is made of a more elastic plastic material than the clamping section with the remaining part of the catch. On the one hand, this achieves an excellent clamping effect for the covering strip, and on the other hand it makes it easy to take the covering strip back off, for example to replace the pane, and allows the covering strip to be removed gently and—especially if it is made of delicate materials such as wood—without destroying it.

An especially advantageous embodiment of the invention is characterized in that said more elastic part is coextruded with the clamping section. This allows the profile to be produced in a single production step along with its clamping section, its catch, and the more elastic part of the catch.

Optionally, the catch is a bulge, a thickening, a projection, or a hook of the clamping section, and produces a good clamping effect.

It is especially advantageous if the remaining part of the catch, that is, the part other than said more elastic part, is a hook, which is completed by said more elastic part to a bulge. Thus, the catch is, so to speak, made in two parts, with a first, less elastic, hook-shaped part to achieve good clamping effect, and a second part that is made of a more elastic material and that completes the hook into a "soft" bulge, this second part elastically deforming as the covering strip is pulled back off, to be gentle to the latter.

Alternatively, it is also possible for the catch to be a wall of a depression in the clamping section, i.e., the catch does not project out, but rather conversely the covering strip has a projection that latches behind the catch.

In any case, it is especially favorable if the catch lies at the end of the clamping section, to take advantage of the elastic effect of the protruding clamping section over its entire length, even if this elastic effect is small.

In principle, the profile can be equipped with one, two, or more clamping sections, which engage into corresponding grooves of the covering strip and/or hold corresponding projections of the covering strip. Optionally, two clamping sections are provided, whose catches face one another, so that they can hold or clamp a projection of the covering strip between them.

The profile can be equipped with other more elastic parts, optionally coextruded ones. For example, the first fastening section can support at least one sealing lip, which in turn is made of a plastic material that is more elastic than the fastening section is.

The second fastening section can be anchored to the frame in various ways, for example by screwing. However, according to a further feature of the invention it is also possible for the second fastening section to have at least one projection to latch in a complementary recess in the frame, allowing the profile to be mounted to the frame without screws.

It is especially favorable if the second fastening section has, at its end, two projections in the form of ribs that stick out in diametrically opposite directions. This produces an approximately T-shaped structure, which can be latched into corresponding recesses in the frame.

Another feature of the invention can also provide that that side of the first fastening section that can be placed against the pane be displaced forward or backward, with respect to that side of the second fastening section that can be anchored to the frame, by an amount that is adapted to the thickness of the pane to be fastened. This allows the profile to be used for all possible combinations of panes and frames, whether it be with panes that project out beyond the frame or with panes that are set back by different distances with respect to the frame.

BRIEF DESCRIPTION OF THE DRAWINGS

The invention is explained in detail below using sample embodiments that are illustrated in the attached drawings. The drawings are as follows.

DETAILED DESCRIPTION

Figure 1:
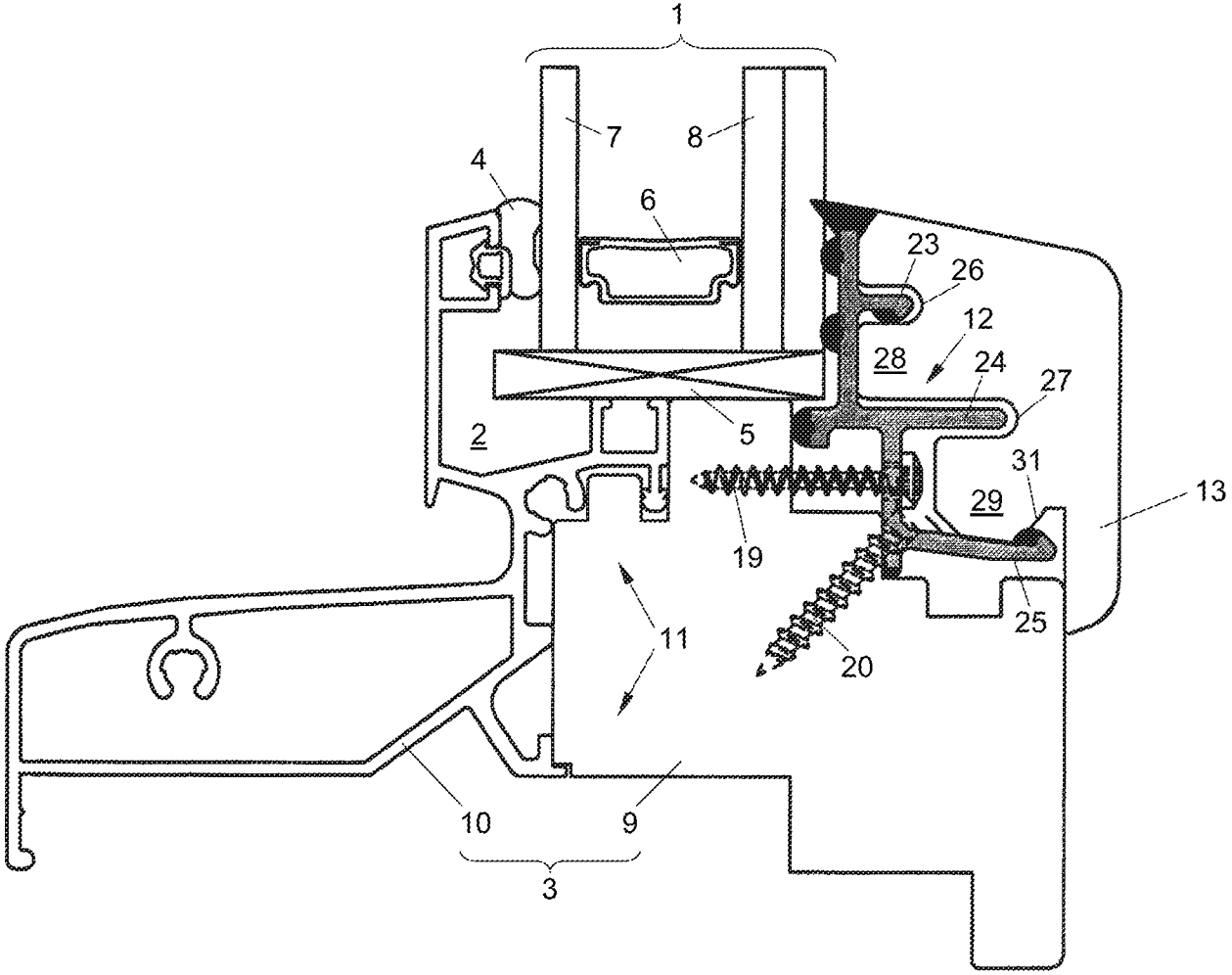
FIG. 1 is a section through the inventive profile installed on a window frame.

FIG. 1 shows a pane 1 whose edge is mounted in the rabbet 2 of a frame 3 with the interposition of elastic seals 4, 5. In the example shown, the pane 1 is a laminated insulating glass pane made of two glass plates 7, 8, namely a single-pane safety glass (ESG) 7 and a laminated safety glass (VSG) 8, which are separated from one another by means of a separating strip 6 around the periphery. However, the pane 1 could also be any other kind of glass pane 1, or also a blind panel or a door panel made of wood, metal, or plastic for an interior wall paneling frame or a structural design.

In the example shown, the frame 3 is a combined wood/aluminum frame for a window or a door, this frame comprising, on the building interior side, a wood profile 9 and, on the building exterior side, an aluminum profile 10, which are fitted together through corresponding tongue-and-groove connections 11. However, the frame 3 could also be a simple wood, plastic, or metal frame, with one or more rabbets 2, and the pane 1 could engage, in a complementary way, into one or more rabbets 2.

The pane 1 is fastened in the rabbet(s) 2 of the frame 3 by means of a profile 12 made of plastic, onto which a covering strip 13 made, e.g., of plastic, metal, or preferably wood, is put or clamped, as will be explained in greater detail below. The covering profile 13 covers the joint between the pane 1 and the frame 3, but preferably also equally covers the entire fastening profile 12.

Figure 2:
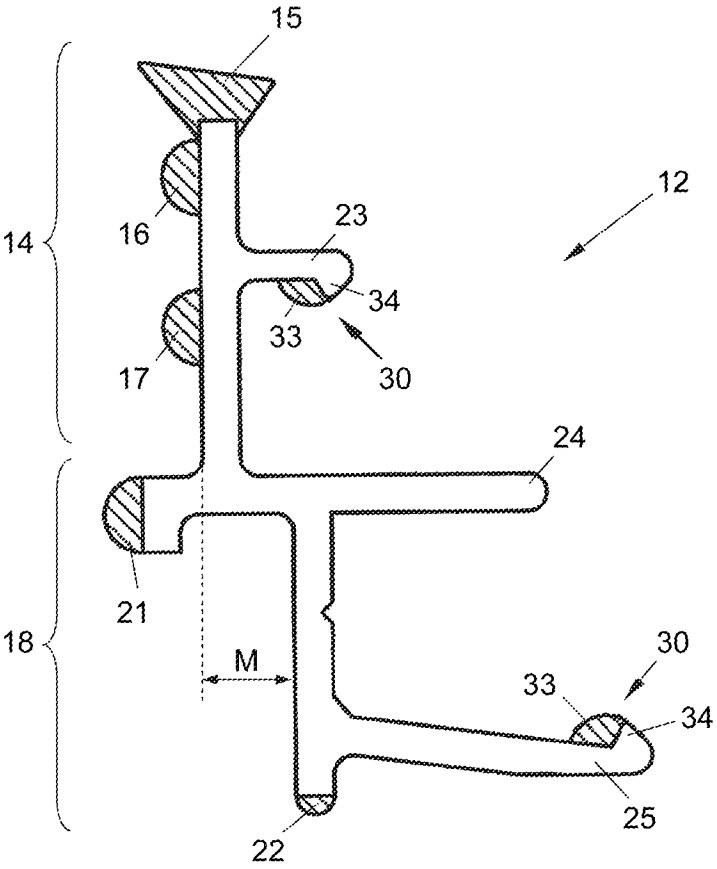
FIG. 2 is an enlarged section through the profile of FIG. 1.

FIG. 2 shows the profile 12 in detail. The profile 12 has a first fastening section 14 that can be put against the pane 1, more precisely against the edge of the pane 1 (see FIG. 1), and in addition it can be equipped with one or more sealing lips 15-17. Furthermore, the profile 12 has a second fastening section 18 that anchors it to the frame 3 (here: its wood profile 9), for which purpose it has, for example, holes for the passage of fastening screws 19, 20 that engage into the frame 3 or the wood profile 9 (FIG. 1). The second fastening section 18 can be equipped with other elastic seals 21, 22 to seal it against the frame 3.

Figure 3:
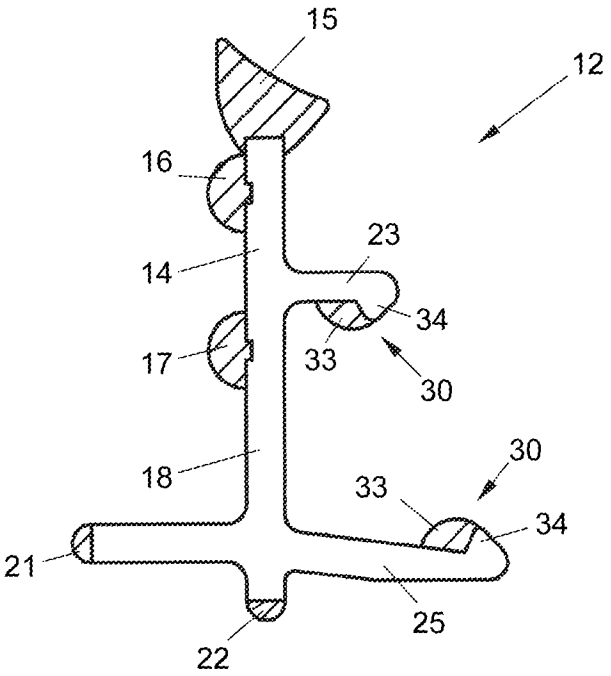
FIG. 3 is a detail section through an alternative embodiment of the inventive profile.
Figure 5:
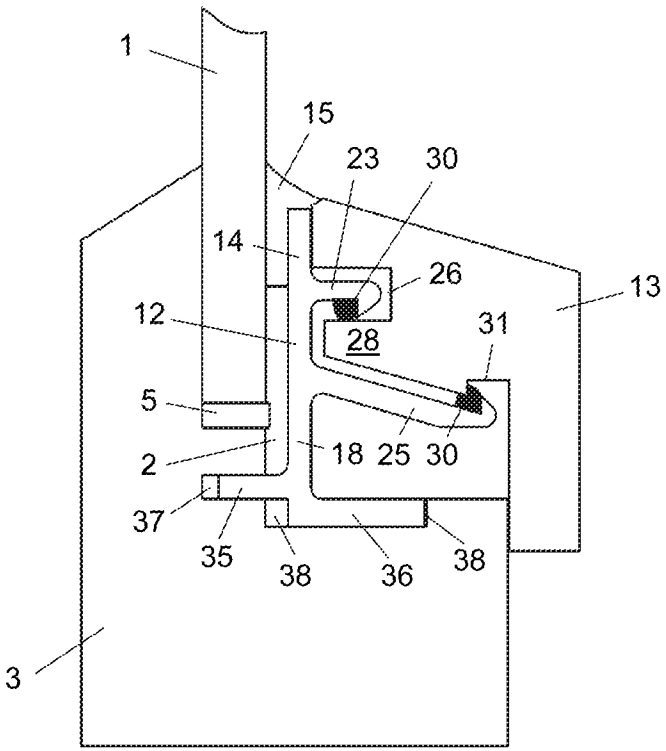
FIGS. 5 and 6 are sections through two other embodiments of the inventive profile, each of which is installed on a window frame.
Figure 4:
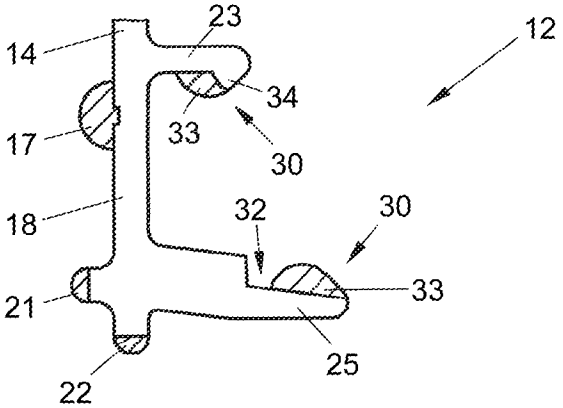
FIG. 4 is a detail section through another embodiment of a profile.

That side of the first fastening section 14 that can be placed against the pane 1 is displaced forward or backward, with respect to that side of the second fastening section 18 that can be anchored to the frame 3, by an amount M that is adapted to the thickness of the pane 1 to be fastened. In the embodiment shown in FIGS. 1 and 2, the fastening section 14 projects forward—when viewed from the side of the pane 1—with respect to the fastening section 18 by the amount M, to fasten a thinner pane 1 to the frame. In the embodiments of FIG. 3 through 5, the amount M=0, i.e., here the first and the second fastening sections 14, 18 run in essentially the same plane. In the embodiment shown in FIG. 6, the first fastening section 14 is set back—when viewed from the side of the glass pane 1—with respect to the second fastening section 18 by the amount M, to hold a thicker glass pane 1.

On the side of the profile 12 facing away from the pane 1, there are one, two, or more clamping sections 23, 24, 25 projecting away from the fastening sections 14, 18, these clamping sections serving to clamp the covering strip 13. In the embodiment shown in FIGS. 1 and 2, three clamping sections are provided, and in the embodiments shown in FIG. 3 through 5 two clamping sections are provided. It goes without saying that an embodiment with only a single clamping section or one with more than three clamping sections is also possible (not shown).

Every one of the clamping sections 23-25 can either engage into a corresponding groove 26, 27 of the covering strip 23 or hold a corresponding projection 28, 29 of the covering strip 13, as is shown in FIGS. 1 and 5.

For secure clamping or latching of the covering strip 13 on or between the clamping sections 23-25, at least one of the clamping sections 23-25 has, here both outermost clamping sections 23, 25 each have, a catch 30, which either clamps in one of the grooves 26, 27 or elastically lies against one of the projections 28, 29 or can latch in or against an undercut 31 of one of the grooves 26, 27 or projections 28, 29.

FIG. 2 through 4 show the structure of the catch 30 in detail. The catch 30 can be a bulge, a thickening, a projection, a hook, or something similar, of the respective clamping section 23, 25, and each can preferably—even if not necessarily—be at the end of the respective clamping section 23, 25. The catch 30 can stick out on one side or on both sides (not shown) of the clamping section 23, 25. Alternatively, the catch 30 can also be formed by the outer wall of a depression 32 in the respective clamping section 23, 25, as is shown for the clamping section 25 in FIG. 4. In this case, although the catch 30 does not stick "out" from the side of the clamping section 25, the covering strip 13 can nevertheless be latched behind it, for example with the help of a hook-shaped projection 28, 29 that engages in a complementary way into the depression 32.

As can be seen from FIG. 2-4, at least one part 33 of the catch 30 is made from a plastic material that is more elastic than the remaining part of 34 of the catch 30. The remaining part 34 can be made in a single piece with the respective clamping section 23, 25. For example, if the clamping section 23, 25—as well as the fastening sections 14, 18 and the rest of clamping section 24—is made from a hard plastic, i.e., a plastic material with a high modulus of elasticity, then the elastic part 33 of the catch 30 is made from soft plastic, i.e., a plastic material with a modulus of elasticity that is low in comparison with it. The more elastic part 33 can be coextruded together with the rest of the part 34 and the clamping section 23, 24 when the profile 12 is produced. Furthermore, the sealing lips 15-17, 21, and 22 can also, in the same way, be coextruded with the profile 12 from a sealing material, for example the same material as the part 33, when the profile 12 is produced.

The remaining part 34 of the catch 30, that is, the part other than the more elastic part 33, can form a type of hook, which is completed by the more elastic part 33 into a bulge whose cross section has the approximate shape of a semicircle or a segment of a circle (FIG. 2, 3). The more elastic part 33 preferably projects slightly beyond the less elastic hook-shaped part 34.

FIG. 4 shows an embodiment in which the entire catch 30, here in the form of a bulge, is made from the plastic material that is more elastic than the clamping section 25; alternatively, the part 33, which here simultaneously forms the entire catch 30, could be shaped into a thickening, a projection, or a hook of the clamping section 25, optionally also on both of its sides.

FIG. 5 shows another embodiment of the profile 12 in which the second fastening section 18 has at least one projection 35, 36 each of which latches in a complementary recess 37, 38 of the frame 3. In the example shown, two projections 35, 36 in the form of ribs are provided, which stick out from the end of the second fastening section 18 in the shape of a "T" and can spread into the recesses 37, 38.

When the profile 12 is set against the pane 1 and the frame 3, first the rib 35 is introduced into the recess 37, while the other rib 36 elastically deforms and finally "jumps" into the recess 38 and latches in it. This allows the profile 12 or its second fastening section 18 to be anchored to the frame 3 without screws.

Figure 6:
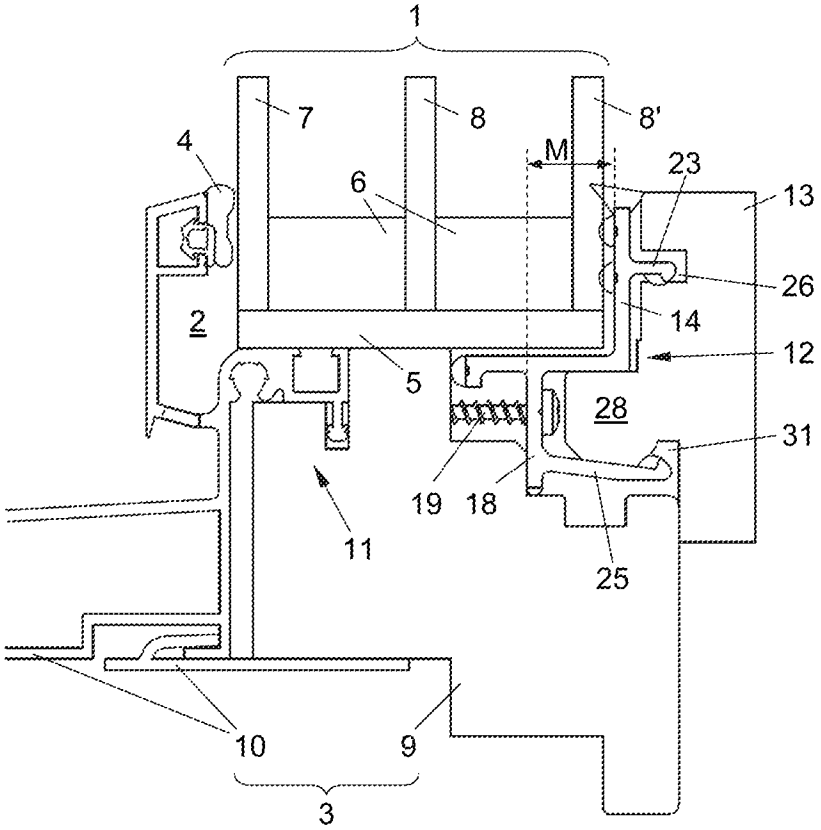

FIG. 6 shows yet another embodiment of the profile 12 to hold a thick pane 1 made of three glass plates 7, 8, 8', which are separated from one another by means of separating strips 6. As was discussed, here the first fastening section 14 of the profile 12 is set back—when viewed from the side of the pane 1—with respect to the second fastening section 18, to hold the thick pane 1. Thus, corresponding selection of the amount M of forward or backward displacement can adapt the profile 12 to panes a of different thickness, without having to change the frame 3 or its rabbet 2 or profiles 9, 10.

Due to the especially elastic nature of the catch 33, it deforms when the covering strip 13 is clipped or clamped on, and adapts well to the grooves 26, 27 or projections 28, 29 of the covering strip 13; and when the covering strip 13 is pulled off or taken back off, the comparatively greater elasticity of the catches 30 protects the grooves 26, 27 and projections 28, 29 of the covering strip 13 as much as possible, so that even covering strips 13 made of delicate materials such as softwood can be taken back off without being destroyed. Thus, after the covering strip 13 is removed, the profile 12 can be taken back off, e.g., by loosening the screws 19, 20 or unlatching the snap connections 35/37, 36/38, and then the pane 1 can be removed from the rabbet(s) 2 of the frame 3 for replacement.

The invention is not limited to the presented embodiments, but rather comprises all variants and modifications that fall within the scope of the associated claims.

What is claimed is:

1. A profile made of plastic material to fasten a pane to a frame, comprising a first fastening section configured to be placed against the pane and a second fastening section configured to be anchored to the frame and at least one clamping section projecting away from the fastening sections and having two free sides that are opposite one another, the clamping section having a catch to clamp a covering strip, wherein the catch sticks out on one or both of said sides of the clamping section and wherein one part of the catch is composed of a more elastic plastic material than the clamping section with a remaining part of the catch.

2. The profile according to claim 1, wherein said part is coextruded with the clamping section.

3. The profile according to claim 1, wherein the catch is a bulge, a thickening, a projection, or a hook of the clamping section.

4. The profile according to claim 1, wherein the remaining part of the catch, that is, the part other than said more elastic part, is a hook, which is completed by said more elastic part into a bulge.

5. The profile according to claim 1, wherein the catch is a wall of a depression in the clamping section.

6. The profile according to claim 1, wherein the catch lies at an end of the clamping section.

7. The profile according to claim 1, further comprising two clamping sections, whose catches face one another.

8. The profile according to claim 1, wherein the first fastening section supports at least one sealing lip, which is made of a plastic material that is more elastic than the first fastening section is.

9. The profile according to claim 1, wherein that side of the first fastening section configured be placed against the pane is displaced forward or backward, with respect to that side of the second fastening section configured to be anchored to the frame, by an amount that is adapted to a thickness of the pane to be fastened.

10. The profile according to claim 1, wherein the second fastening section has at least one projection to latch in a complementary recess of the frame.

11. The profile according to claim 10, wherein the second fastening section has an end including two projections in the form of ribs that stick out in diametrically opposite directions.

* * * * *